US005212718A

United States Patent [19]

Casanova

[11] Patent Number: 5,212,718

[45] Date of Patent: May 18, 1993

[54] GAMMA RAY COLLIMATOR

[75] Inventor: Edgar J. Casanova, Pass Christian, Miss.

[73] Assignee: The United States of America as represented by the Administrator of the National Aeronautics and Space Administration, Washington, D.C.

[21] Appl. No.: 740,675

[22] Filed: Aug. 6, 1991

[51] Int. Cl.[5] ..... G21F 5/02

[52] U.S. Cl. ..... 378/147; 378/203; 250/506.1

[58] Field of Search ..... 378/147, 203, 193, 145; 250/505.1, 506.1, 515.1

[56] References Cited

U.S. PATENT DOCUMENTS 3,655,983 4/1972 Forrer ..... 250/497.1
4,147,618 4/1979 Richardson et al. ..... 378/147
5,038,370 8/1991 Harding et al. ..... 378/147
5,065,033 11/1991 Parsons ..... 378/203

FOREIGN PATENT DOCUMENTS 0040280 11/1981 European Pat. Off. ..... 378/203

*Primary Examiner*—David P. Porta
*Attorney, Agent, or Firm*—Robert L. Broad, Jr.; Guy M. Miller; John R. Manning

[57] ABSTRACT

A gamma ray collimator including a housing having first and second sections. The first section encloses a first section of depleted uranium which is disposed for receiving and supporting a radiation emitting component such as cobalt 60. The second section encloses a depleted uranium member which is provided with a conical cut-out focusing portion disposed in communication with the radiation emitting element for focusing the emitted radiation to the target.

8 Claims, 6 Drawing Sheets

GAMMA RAY COLLIMATOR

ORGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 U.S.C. 2457).

BACKGROUND OF THE INVENTION

Typically, non-destructive radiographic techniques are used to radiograph the weldments of large diameter high pressure vessels with thick walls without access to the interior of the vessel. The present radiographic procedures demand unacceptably long exposure times in order to meet the testing standards set forth by ASME, Section V. Such long exposure times require that the pressure vessel be kept out of service for a long period of time. Additionally, the restricted area (surrounding the radiographic procedure) necessary for personnel is 1,257 feet. This safety requirement impacts the normal operation where the vessel is located.

The use of radioisotopes to provide the gamma ray source for radiographic examination presents a problem in that the isotope sources present a severe radiation hazard and when not in actual use must be handled carefully and stored and locked in shielded containers. Thus, remote handling of the gamma ray source is necessary and such remote handling requires that the gamma ray source (cobalt 60, in the present application) be first moved by remote controls) from the center to the surface of a shielded container and then to a point some distance away. In the present application, this point is a collimator mounted adjacent the pressure vessel to be tested.

The collimator of the present invention is designed to support and shield Co 60 during actual radiographic exposure and to focus the radiation from the Co 60 onto the weldment of the pressure vessel. The collimator allows the radiation to be emitted in a uniform path toward through the point (surface) being tested toward a film which is used to record the amount of radiation passing through the tested surface. The collimator is designed to shield the Co 60 in such a manner as to prevent an excessive amount of radiation from being emitted in unwanted directions. An additional benefit provided by the instant collimator is the mitigation of undesirable backscatter radiation which adversely affects the quality of radiographs thus, permitting the radiographer to produce radiographs with excellent quality and sensitivity. Another feature of the collimator of the present invention is that it reduces the restricted safety area by 95%. Example: safe stand-off distance 61 feet with the collimator of the present invention versus 1,256.7 feet with no collimator. Additionally, the present collimator greatly reduces the radiographic exposure time of presently used radiographic equipment when used in conjunction with a special technique under development.

It is an object of the present invention therefore, to provide a gamma-ray collimator for non-destructive testing of pressure vessels or the like.

It is a further object of the present invention to provide such a collimator for supporting and shielding a radioisotope source during the non-destructive testing procedure.

It is another object of the present invention to provide such a collimator with means for focusing the radiation in a predetermined uniform path to the target.

It is yet another object of the present invention to provide such a collimator which prevents excessive backscattering of radiation and thus enhances the quality and sensitivity of the radiographs.

DESCRIPTION OF THE PREFERRED EMBODIMENT

Figure 1:
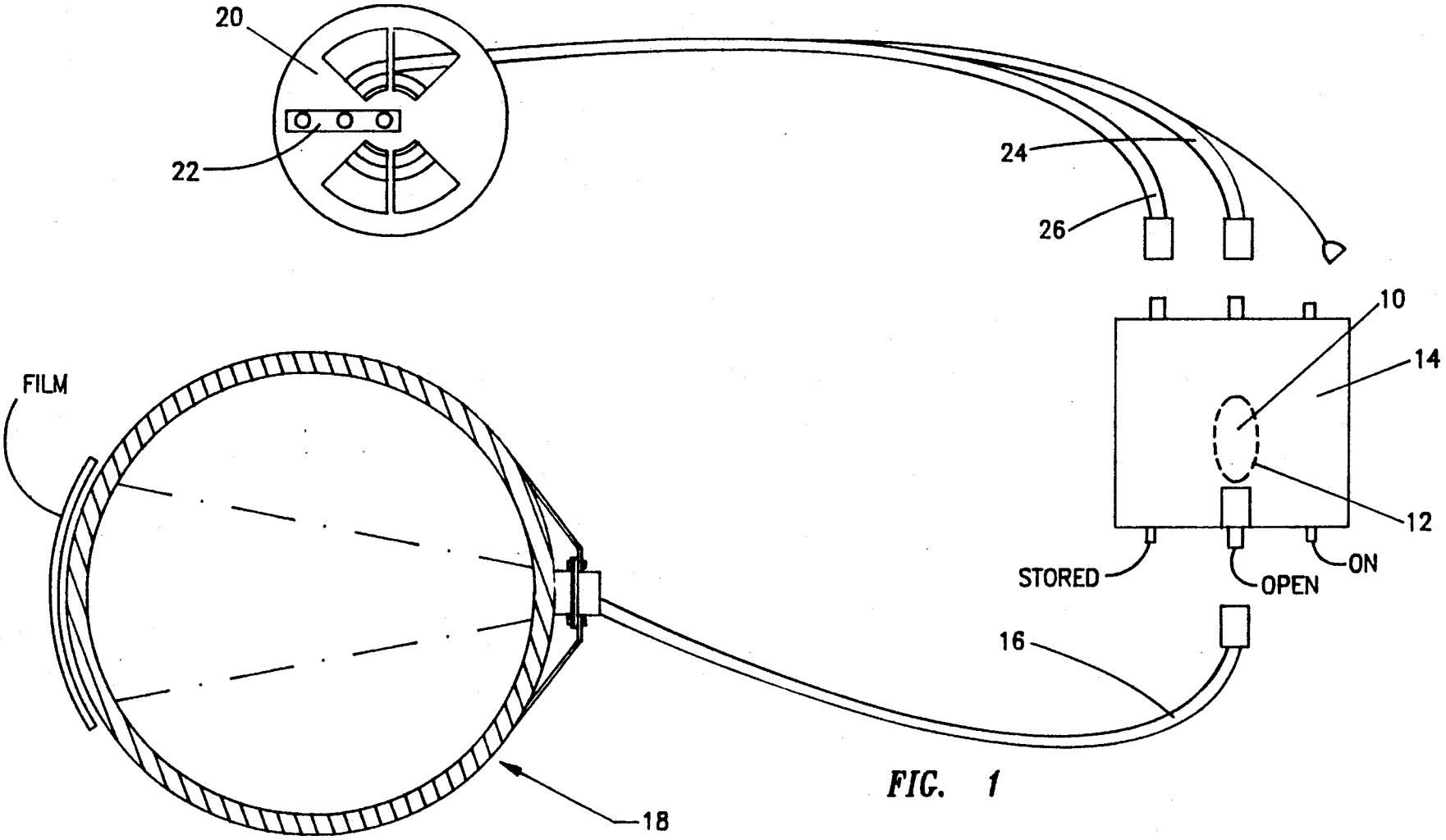
FIG. 1 is a diagrammatic view illustrating the use of remotely controlled apparatus utilized in practicing the principles of the present invention.

Typically, in a radiographic process (FIG. 1) an isotope source 10 is housed in a shielded pig 12 which is disposed in a shield case assembly 14. Shield case assembly 14 includes switches and elastically actuated mechanisms for "cranking" the radioisotope (Cobalt 60, for example) element out of the shield case assembly and into a source tube assembly 16 which is in communication with the collimator assembly 18 of the present invention. Collimator assembly 18 focuses the radiation on the weldment of the pressure vessel being tested as shown in FIG. 1. The mechanism for cranking the cobalt 60 out of the storage container is well known in the art.

The shield case assembly 14 of FIG. 1 has the cranking mechanism connected to it and the cranking mechanism includes a reel assembly 20 having a control box 22 whereon and armored cable tubes 24 and 26 which "cranks" the radioactive element out of the container 14 and through source tube assembly 16 to collimator 18. To indicate the status of shield case assembly 14, "on", "stored" and "open" indicator lights are mounted on the housing thereof. The reel assembly, shield case assembly, controls, and the source tube assembly form no part of the collimator of the present invention and are well known in the art.

Figure 2:
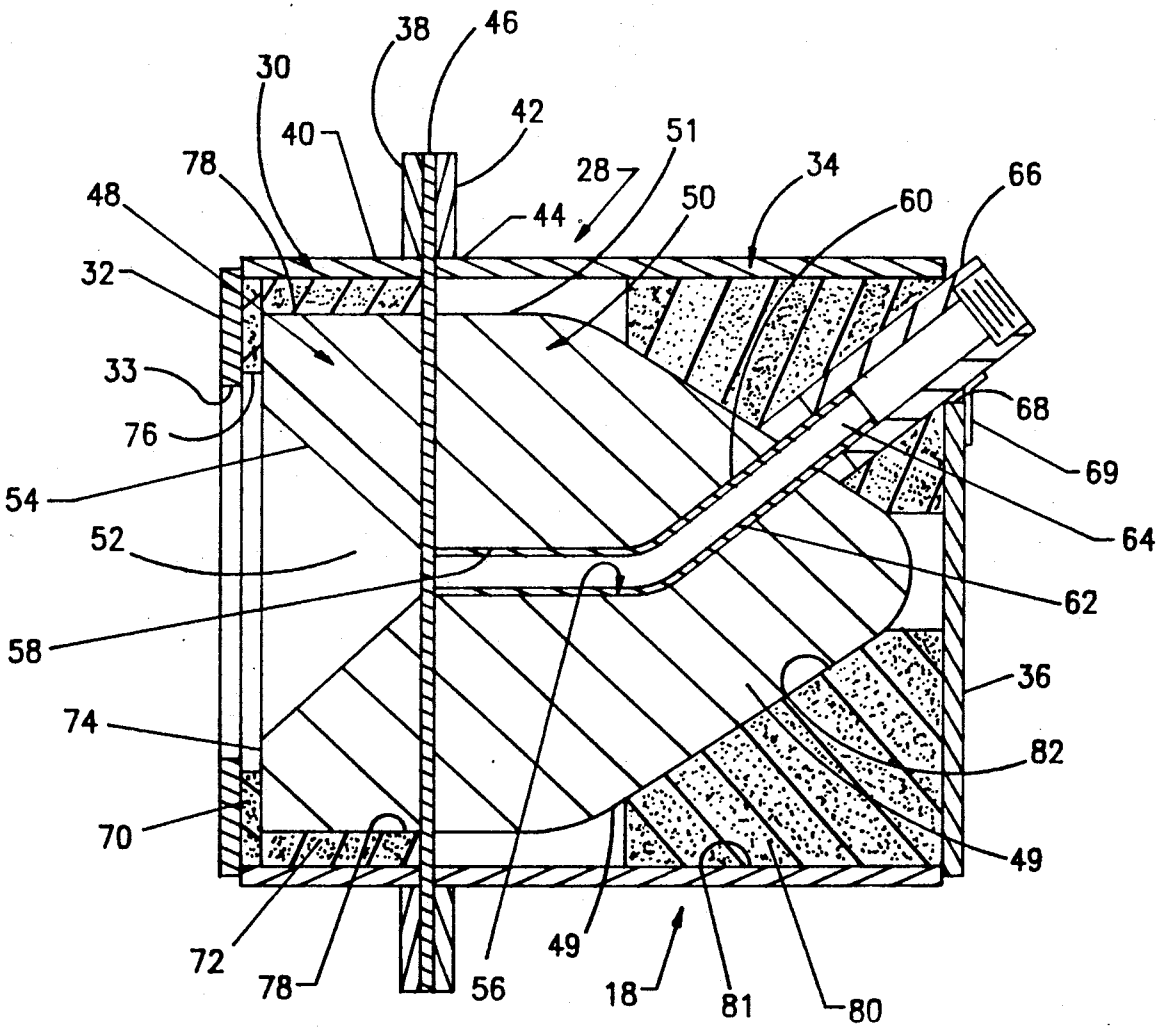
FIG. 2 is a longitudinal cross-sectional view of a collimator assembly of the present invention illustrating a housing for enclosing the depleted uranium used in the practice of the invention.

As seen in FIG. 2, the collimator assembly 18 of the present invention includes a housing assembly 28 having a forward cylindrical (focussing) section 30 provided with a front cover plate 32 and a rear section 34 having a rear cover plate 36. Rear section 34 serves to support and shield the radioisotope element during the testing process. A circular flange 38 is attached (as by welding, etc.) to the rear portion 40 of forward housing section 30 and a substantially circular flange 42, having a cut-out portion 43 (FIG. 3), is attached (as by welding) at the forward portion 44 of rear section 34 of the housing. A circular separator plate 46 (typically, stainless steel) is disposed between flanges 38 and 42 and serves as a cover plate for the rear section 34 of the housing.

It is to be understood that while lead is typically used to shield radioisotope material, the present invention uses spent (depleted) uranium. The depleted uranium shield will weigh considerably less than a lead shield that would provide the same amount of attenuation and may be easily directly handled by a person. In the collimator of the present invention the depleted uranium supports and shields the radioisotope (Co 60) in the housing and focuses the radiation onto the object to be tested.

Figure 4:
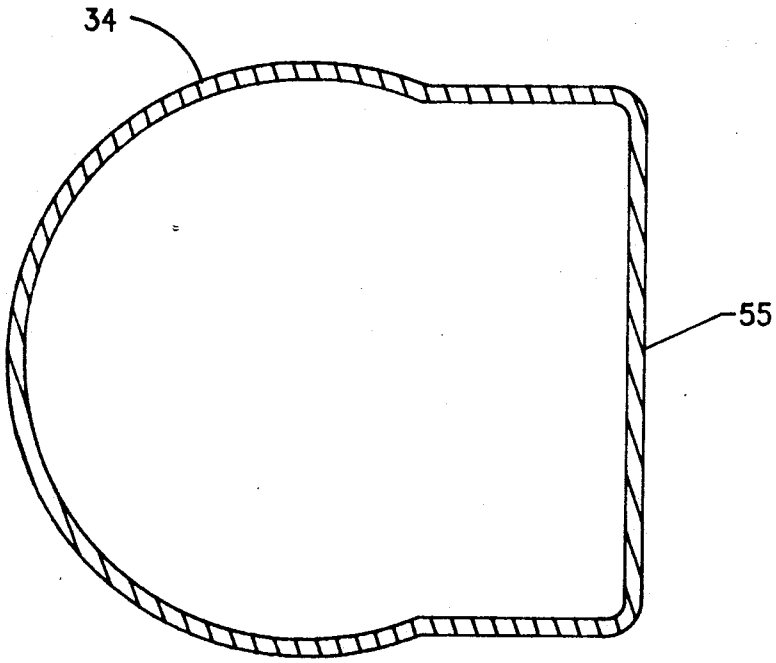
FIG. 4 is a sectional view taken along line 4—4 of FIG. 3.
Figure 6:
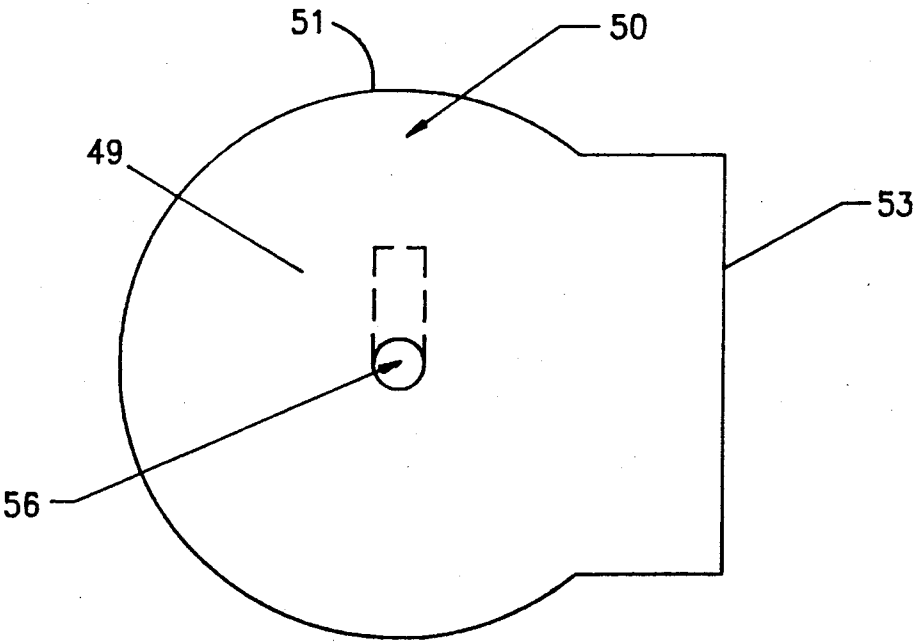
FIG. 6 is an end elevational view of the depleted uranium shown in FIG. 5.
Figure 5:
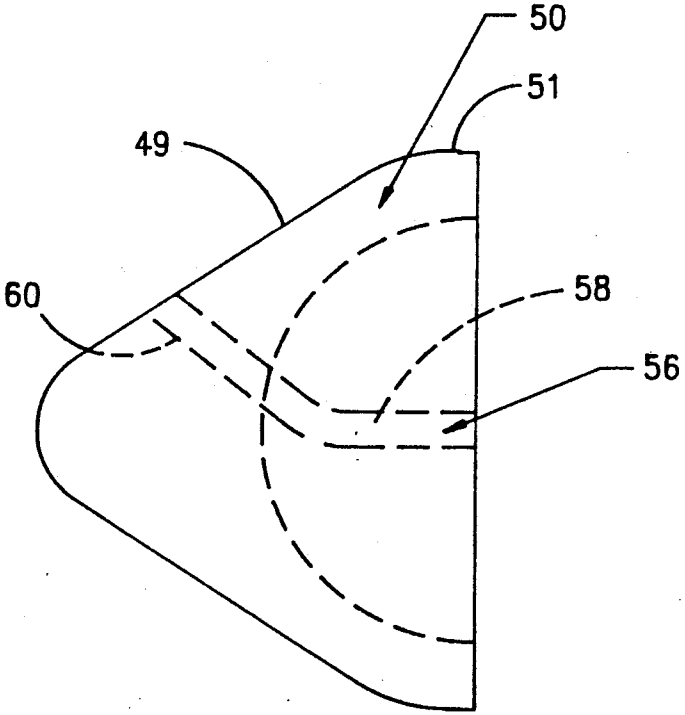
FIG. 5 is a side elevational view of the depleted uranium.

As further seen in FIG. 2, the depleted uranium is comprised of two sections 48 and 50. Section 48 is an annular member (FIG. 2) having a central opening 52 and a bevelled surface 54 which serves to focus the radiation out of the housing. As seen in FIGS. 2, 5 and 6, the second section 50 of the depleted uranium includes an end portion 49 having a substantially conical configuration and a second portion 51 having a substantially circular configuration. Section 50 further includes a side portion 53 (FIGS. 5 and 6) extending therefrom. This is an "off-the-shelf" item and is available with the side portion 53 thereon. If desired, the side portion 53 may be machined off the uranium member to provide the section 50 with a substantially circular transverse cross-sectional configuration which may be housed in a cylindrical housing. However, if the side protrusion is retained the housing may be provided with a protruding housing addition 55 (FIGS. 3 and 4) to enclose the protruding side portion 53 as described hereinbelow.

Figure 3:
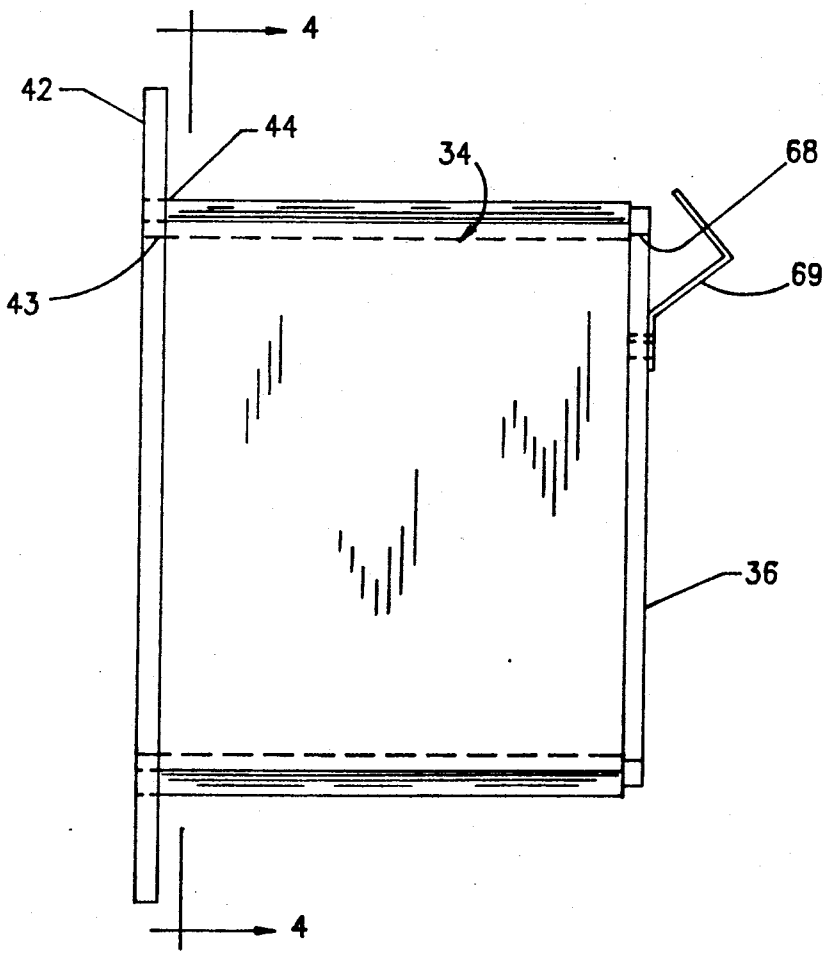
FIG. 3 is a side elevational view of the rear housing section for housing one section of the depleted uranium.

In any event, uranium section 50 (FIGS. 2, 5 and 6) is provided with an opening 56 extending therethrough. Opening 56 includes a straight, axial portion 58 and an angled portion 60. A tubular member 62 (FIG. 2) having a configuration similar to opening 56 is supported in opening 56. Tubular member 62 includes an extending end portion 64 which extends into a threaded brass insert 66. Insert 66 extends through an opening 68 provided in end plate 36 (FIGS. 1 and 3). A bracket 69 is secured to end plate 36 and supports the brass insert 66.

To support uranium sections 48 and 50 in the housing sections 30 and 34, a plurality of cushioning members are provided. Typically, the cushioning members are made of polypropolene. As can be seen in FIG. 2, a pair of cushioning members 70 and 72 are respectively provided at the end and around spent uranium section 48 to support the uranium section 48 and to provide a cushion against impact. Member 70 is provided with a flat annular configuration and is positioned between end plate 32 and the end surface 74 of uranium section 48. An opening 76 in cushion member 70 is axially aligned with an opening 33 of end plate 32. Cushion member 72 is provided with a cylindrical configuration and is positioned between the outer surface 78 of uranium section 48 and the inner surface of cylindrical housing member 30.

Figure 8:
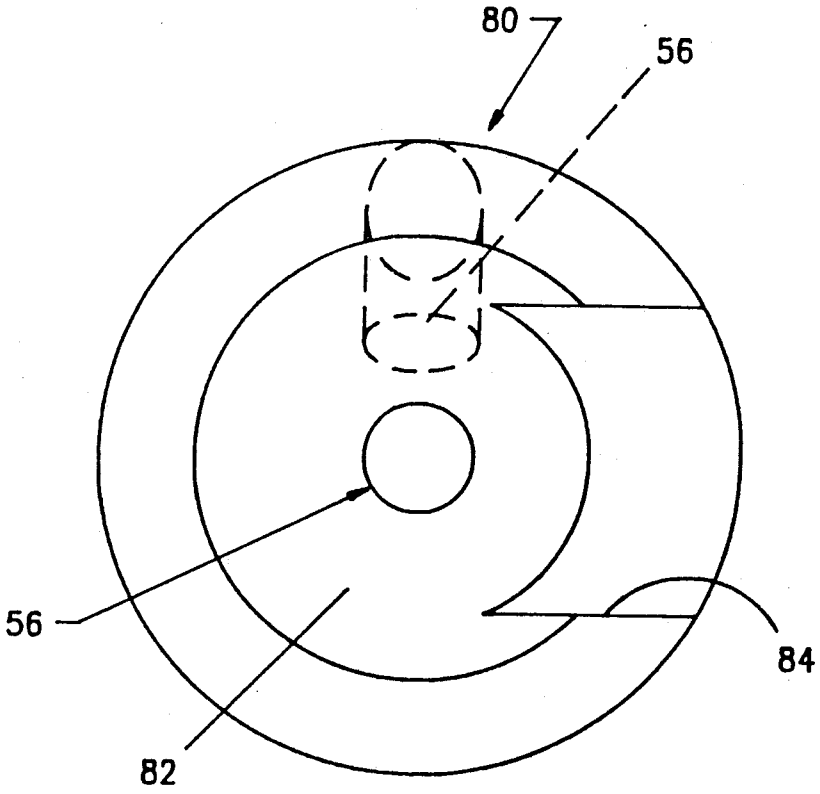
FIG. 8 is a front elevational view of the filler material shown in FIG. 7.
Figure 7:
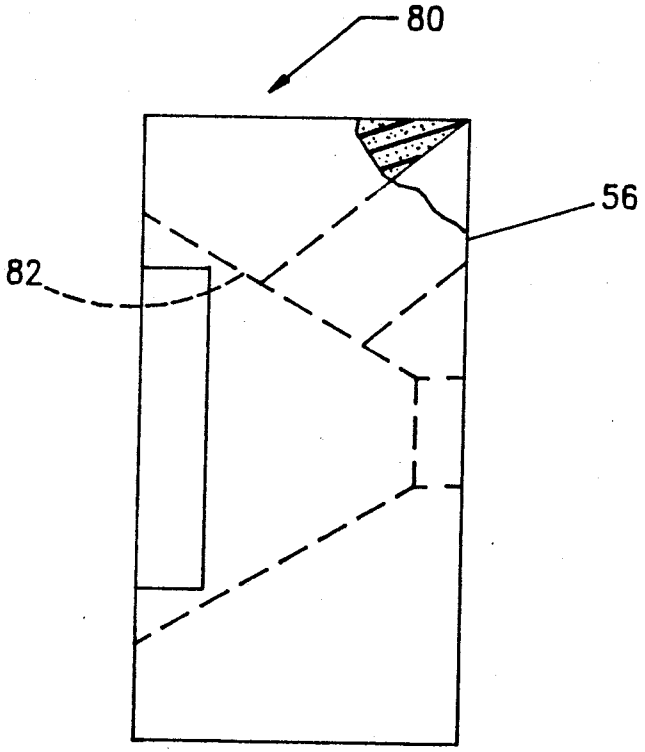
FIG. 7 is a side elevational view, partially in section, of the polypropolene filler material shown in the rear housing section of FIG. 2.

To support and cushion the uranium member 50 in the rear housing member 34, a cushioning member 80 is positioned around the conical end portion 49 of uranium member 50. Cushion member 80 (FIGS. 2, 7 and 8) is positioned between member 50 and the inner surface 81 of cylindrical rear housing member 34 and end plate 36 (FIG. 2) and is provided with a substantially conical internal surface 82 which mates against the conical end portion 49 of uranium member 50. Member 80 further includes a cut-out portion 84 (FIG. 8) to support the protruding portion 53 (FIGS. 5 and 6) of uranium member 50 therein.

Figure 10:
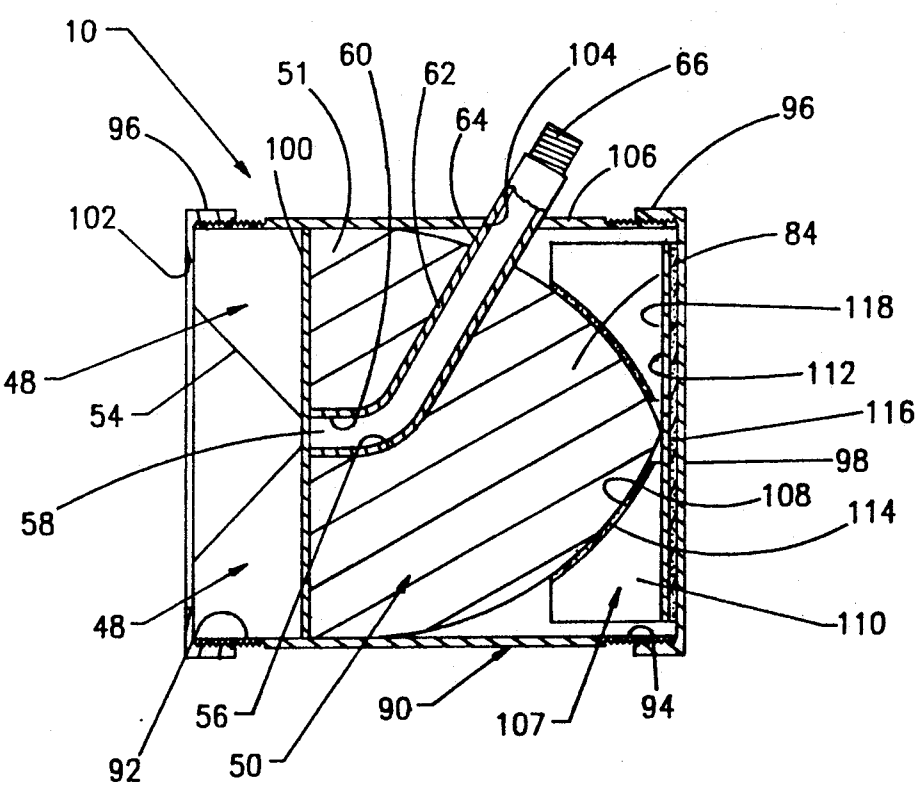
FIG. 10 is a sectional view taken along lines 10—10 of FIG. 9.
Figure 9:
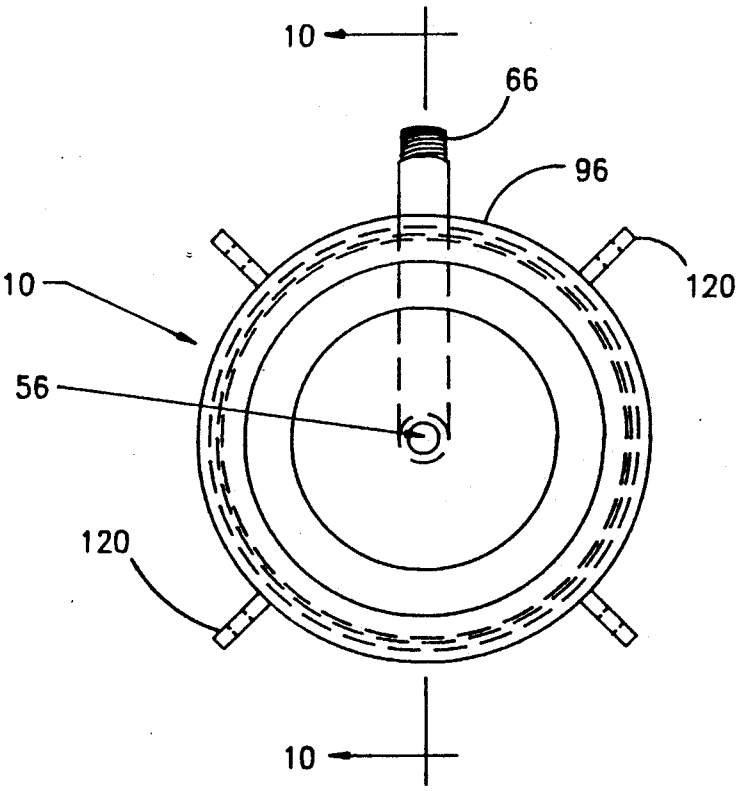
FIG. 9 is a forward elevational view of another embodiment of the present invention.

FIGS. 9 and 10 illustrate another embodiment of the present invention wherein like references refer to like parts. In this embodiment, the uranium section 50 is provided with substantially circular portion 51 and substantially conical end portion 84. No portion of the uranium section 50 protrudes from the side as previously discussed. Additionally, in this embodiment the housing is tubular and includes threaded ends. Threaded end plates are secured at the ends of the housing.

As seen in FIG. 10, the collimator 18 includes an encasement cylinder 90 having threaded ends 92 and 94. An end cap 96 is disposed in threaded relation with end 92 of encasement cylinder 90. A second end cap 98 is disposed in threaded relation with end 94 of encasement cylinder 90. The annular uranium section 48 and the substantially conical uranium section 50 is mounted in the encasement cylinder 90, and a separator plate 100 is mounted in the cylindrical housing between sections 48 and 50. Uranium sections 48 and 50 are constructed as previously described but without the side protrusion 53. Cap 96 is provided with an opening 102 which is slightly larger in diameter than the tapered opening 54 of uranium section 48. Opening 56 is provided with the tubular member 62 therein and includes extending end portion 64 which extends through an opening 104 provided in the wall 106 of cylindrical housing 90.

The second uranium section 50 is shown to include the circular front section 51 and the rear conical portion 49 which is supported in a bracket 107. Bracket 137 is provided an ogival shaped interior surface 108 which is similar in configuration to the rear conical portion 49 of member 50. Bracket 107 is formed by a plurality of spaced gussets 110 which extend from a forward attachment plate 112 which is secured to end plate 96. The inner surfaces of the curved gussets 110 are lined with an open cell sponge rubber pad 114 against which depleted uranium load 50 rests. An open cell sponge rubber pad 116 is secured between the back surface 118 of attachment plate 112 and end cap 96. Externally mounted brackets 120 (FIG. 9) are disposed peripherally around the assembly to secure the assembly to the pressure vessel to be tested.

In operation, the collimator is placed at the desired location on the vessel (FIG. 1). The source tube end is connected to the collimator and the gamma ray source is cranked out of its protective storage container directly into the collimator. The exposure is timed and the source returned to the storage container.

As can be seen from the above description the present collimator focuses the gamma rays toward a target specimen while reducing the radiation level around the back and sides of the collimator. In one specific design, the collimator is designed to house 200 curies of cobalt 60 during actual radiographic exposure with a decrease from 212 CI to 0.5CI of radiation in unwanted directions. The design of the collimator also mitigates undesirable backscatter which improves the quality and sensitivity of the radiograph.

I claim:

1. A collimator for receiving and supporting a radioactive component therein and for directing radioactive emissions from said radioactive component to a target for non-destructive radiographic testing thereof comprising:

a housing having a first section provided with a closed end and a second section provided with an open end;

shielding means carried in said housing and disposed for support of said radioactive component therein, said shielding means being comprised of depleted uranium and having first and second sections, said first section of said shielding means carried in said first section of said housing and being provided with passage means including a bore disposed in communication with the exterior of shielding means to receive and support said radioactive component in said first section of said shielding means during the radiographic testing process, said second section of said shielding means being carried in said second section of said housing;

retaining means for retention of said radioactive component in said first section of said shielding means during the radiographic testing process, said retaining means being a retaining member positioned to limit the extent of movement of said radioactive component in said bore of said first shielding section;

focussing means formed in said second section of said shielding means for focussing the radioactive emissions to said target, said focussing means defined by an annular portion having a central opening aligned with said bore of said shielding means for directing the radioactive emissions through said open end of said housing; and impact resisting means for support of said shielding means in said housing.

2. A collimator as set forth in claim 1 including a tubular member disposed in said bore of said first section of said shielding means, said tubular member having a distal end extending from said housing, whereby said radioactive component may be inserted into said tubular member and positioned adjacent said retaining means.

3. A collimator as set forth in claim 2 wherein said retaining means is a continuous metallic member forming a wall between said first and second sections of said housing.

4. A collimator as set forth in claim 3 wherein said first section of said housing is provided with an end plate secured thereto to form said closed end of said housing.

5. A collimator as set forth in claim 4 wherein said housing is a substantially cylindrical enclosure having an end cap provided with a central opening therein forming said open end of said housing.

6. A collimator as set forth in claim 5 including bracket means for attaching said collimator to said target for the radiographic testing thereof.

7. A collimator as set forth in claim 5 wherein said impact resisting means is comprised of polypropolene.

8. A collimator as set forth in claim 6 wherein said impact resisting means are polypropolene members disposed in surrounding relation with said shielding means.

* * * * *